US006851926B2

(12) United States Patent
Guinessine et al.

(10) Patent No.: US 6,851,926 B2
(45) Date of Patent: Feb. 8, 2005

(54) VARIABLE THICKNESS TURBINE BUCKET COVER AND RELATED METHOD

(75) Inventors: Leonid Yulyevich Guinessine, Moscow (RU); Anil Kumar Tolpadi, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 54 days.

(21) Appl. No.: 10/248,999

(22) Filed: Mar. 7, 2003

(65) Prior Publication Data

US 2004/0175266 A1 Sep. 9, 2004

(51) Int. Cl.[7] ..... F01D 11/08

(52) U.S. Cl. ..... 415/173.1; 415/173.4; 416/195

(58) Field of Search ..... 415/173.1, 173.4, 415/173.5, 173.6; 416/189, 190, 191, 192, 195

(56) References Cited

U.S. PATENT DOCUMENTS 5,267,834 A 12/1993 Dinh et al.
5,393,200 A 2/1995 Dinh et al.
5,445,498 A 8/1995 Williams et al.
5,509,784 A 4/1996 Caruso et al.
5,890,873 A 4/1999 Willey
6,036,437 A 3/2000 Wolfe et al.
6,139,019 A * 10/2000 Dinc et al. ..... 277/355
6,363,612 B1 4/2002 Roberts et al.
6,454,534 B1 9/2002 Burnett et al.

* cited by examiner

*Primary Examiner*—Edward K. Look
*Assistant Examiner*—Dwayne White
(74) *Attorney, Agent, or Firm*—Nixon & Vanderhye P.C.

(57) ABSTRACT

A turbine bucket and cover assembly includes a bucket having a shank portion and an airfoil portion separated by a platform portion; and a bucket cover arranged on a sloped radially outer tip of the airfoil portion, the bucket cover having a radially inner surface matching the sloped edge and a radially outer surface lying in a plane parallel to a longitudinal axis of a rotor on which the bucket is adapted to be mounted. A related method includes the steps of a) providing a bucket cover having substantially parallel radially inner and outer surface; b) removing material from the bucket cover so as to form a new radially outer surface defining an acute angle relative to the radially inner surface; and c) securing the bucket cover on the sloped airfoil tip of the turbine bucket such that the radially outer surface is substantially parallel to the turbine rotor axis.

11 Claims, 3 Drawing Sheets

VARIABLE THICKNESS TURBINE BUCKET COVER AND RELATED METHOD

BACKGROUND OF INVENTION

This invention relates to steam turbine machines and more particularly, to a bucket cover design for turbine buckets or blades with inclined tips, and to a labyrinth seal arrangement for interaction with the modified bucket cover.

Bucket covers are typically connected to the radially outer tips of turbine buckets or blades to dampen vibration and to prevent twisting of the blades. The bucket covers also cooperate with seal devices such as labyrinth seal teeth for minimizing leakage of gas or steam past the bucket tips. Typically, bucket covers comprise small, flat, uniform-thickness plates attached to the tips of the buckets by reception of a tenon on the bucket tip within an opening in the cover, with subsequent deformation of the tip of the tenon to secure the cover in place. For certain turbine stages, in the low pressure section of a steam turbine for example, the bucket tip is inclined relative to horizontal. A uniform thickness cover on the inclined bucket tip, however, reduces the surface area available for interaction with the generally horizontally oriented labyrinth teeth because of axial movement of the rotor relative to the stator partitions of turbine labyrinth teeth, and thus results in increased tip leakage losses. For certain turbine stages, this design requires that the bucket cover itself be provided with additional seal teeth but this arrangement still does not sufficiently reduce tip leakage losses, nor does it promote commonality of seal configurations among different turbine stages.

SUMMARY OF INVENTION

This invention provides a modified bucket cover design that allows an increased number of labyrinth teeth to interact with the radially outer surface of the bucket cover to reduce tip leakage losses when the bucket is mounted on a turbine rotor. In the exemplary embodiment, a variable thickness bucket cover is provided that has a radially inner surface conforming to the inclined radial tip of the bucket and a radially outer surface that is substantially horizontal, i.e., parallel to the array of labyrinth seal teeth or by way of reference, parallel to the longitudinal axis of the rotor. It is understood in this regard that the bucket covers and the labyrinth seal teeth, collectively, are arranged circumferentially about the periphery of the rotor wheel, but that in any vertical cross-sectional view, the bucket platform and the array of labyrinth teeth will appear as generally horizontal and parallel to the turbine rotor axis. The manner in which the bucket cover is secured by the tenon is not affected by the modified cover.

In the exemplary embodiment, the inclination of the bucket tip is relatively small (about 5°), and the modified cover may be produced by machining a like angle from the radially outer surface of the cover to provide a smooth, horizontal surface that is substantially parallel to the array of labyrinth teeth and to the rotor axis. The seal teeth on the cover itself are also removed, thereby permitting the bucket cover to be used with more common labyrinth seals found in other turbine stages. The modified bucket cover in accordance with the invention can thus be made using existing manufacturing methods.

Accordingly, in one aspect, the invention relates to a turbine bucket and cover assembly comprising a bucket having a shank portion and an airfoil portion separated by a platform portion; and a bucket cover arranged on a sloped radially outer tip of the airfoil portion, the bucket cover having a radially inner surface matching the sloped tip and a radially outer surface lying in a horizontal plane.

In another aspect, the invention relates to a turbine bucket and labyrinth seal assembly for a steam turbine comprising a bucket having a shank portion and an airfoil portion separated by a platform portion; a bucket cover arranged on a sloped radially outer tip of the airfoil portion, the bucket cover having a radially inner surface matching the sloped edge and a radially outer surface; a labyrinth seal radially outward of the bucket cover, the labyrinth seal comprising a plurality of seal teeth arranged in a substantially horizontal array relative to the radially outer surface, and wherein the radially outer surface of the bucket cover lies in a plane substantially parallel to the substantially horizontal array of seal teeth.

In still another aspect, the invention relates to a method of preparing a turbine bucket cover for use with a turbine bucket adapted for mounting on a rotor having a sloped airfoil tip comprising a) providing a bucket cover having substantially parallel radially inner and outer surfaces; b) removing material from the bucket cover so as to form a new radially outer surface defining an acute angle relative to the radially inner surface; and c) securing the bucket cover on the sloped airfoil tip of the turbine bucket such that the radially outer surface is adapted to be substantially parallel to a longitudinal axis of the rotor.

The invention will now be described in detail, with reference to the drawings identified below.

DETAILED DESCRIPTION

Figure 1:
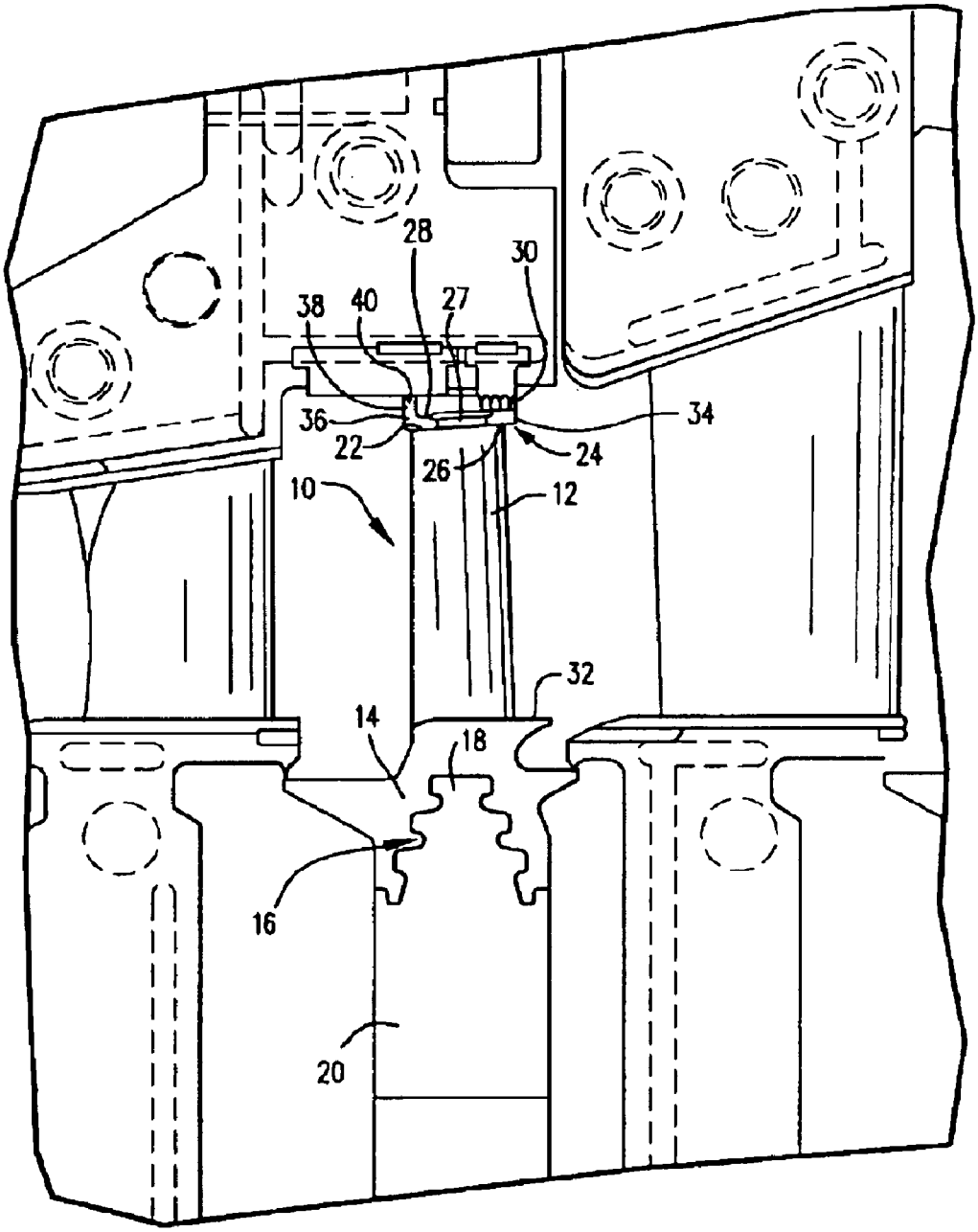
FIG. 1 is a side elevation of a conventional bucket and labyrinth seal arrangement.

With reference to FIG. 1, a steam turbine bucket 10 includes an airfoil portion 12 and a shank portion 14. The shank portion 14 is formed with a female attachment portion 16 that is adapted to mate with a male attachment portion 18 formed on the periphery of the wheel 20 on the turbine rotor. This is sometimes referred to as a "Christmas tree" arrangement. It will be appreciated that, for purposes of this invention, the manner in which the bucket is secured to the rotor wheel, however, is not limited to the illustrated embodiment but includes all suitable equivalent securing techniques.

The radially outer tip of the airfoil portion is defined by a sloped edge 22 which is engaged by a bucket cover 24. Edge 22 is also provided with a radially outwardly extending tenon 27 that receives the bucket cover 24 via an opening therein. The tenon 27 is subsequently deformed to thereby secure the cover on the bucket. The tenon construction and the manner in which the bucket cover is retained by the tenon is conventional and need not be further described.

The radially inner surface 26 of the bucket cover is seated on the sloped edge 22 of the airfoil portion, and because the inner surface 26 is parallel to the outer surface 28, the latter also assumes an inclined or sloped relationship vis-a-vis the adjacent labyrinth teeth 30 and by way of further reference, for example, the rotor axis. Note in this regard that the front and back edges 34, 36 of the bucket cover 24 are substantially perpendicular to the radially inner and outer surfaces 26, 28, such that the cover 24 has a regular rectangular cross-sectional shape. For the bucket illustrated in FIG. 1, the outer surface 28 is sloped about 5° relative to horizontal—or to the rotor axis (not shown).

Because of the sloped orientation of the outer surface 28, only limited engagement is possible with the array of radially outward labyrinth seal teeth 30. In this regard, the array of teeth 30 may be viewed as being substantially horizontally oriented, i.e., substantially parallel to the rotor axis (not shown). Note also that the cover 24 may also be formed with a projecting hook portion 38 that is provided with labyrinth teeth 40. This design, however, does not reduce tip leakage losses to the extent desired. In addition, the design for bucket cover 24 is unlike cover designs for other turbine stages, thus requiring specialized labyrinth seals.

Figure 2:
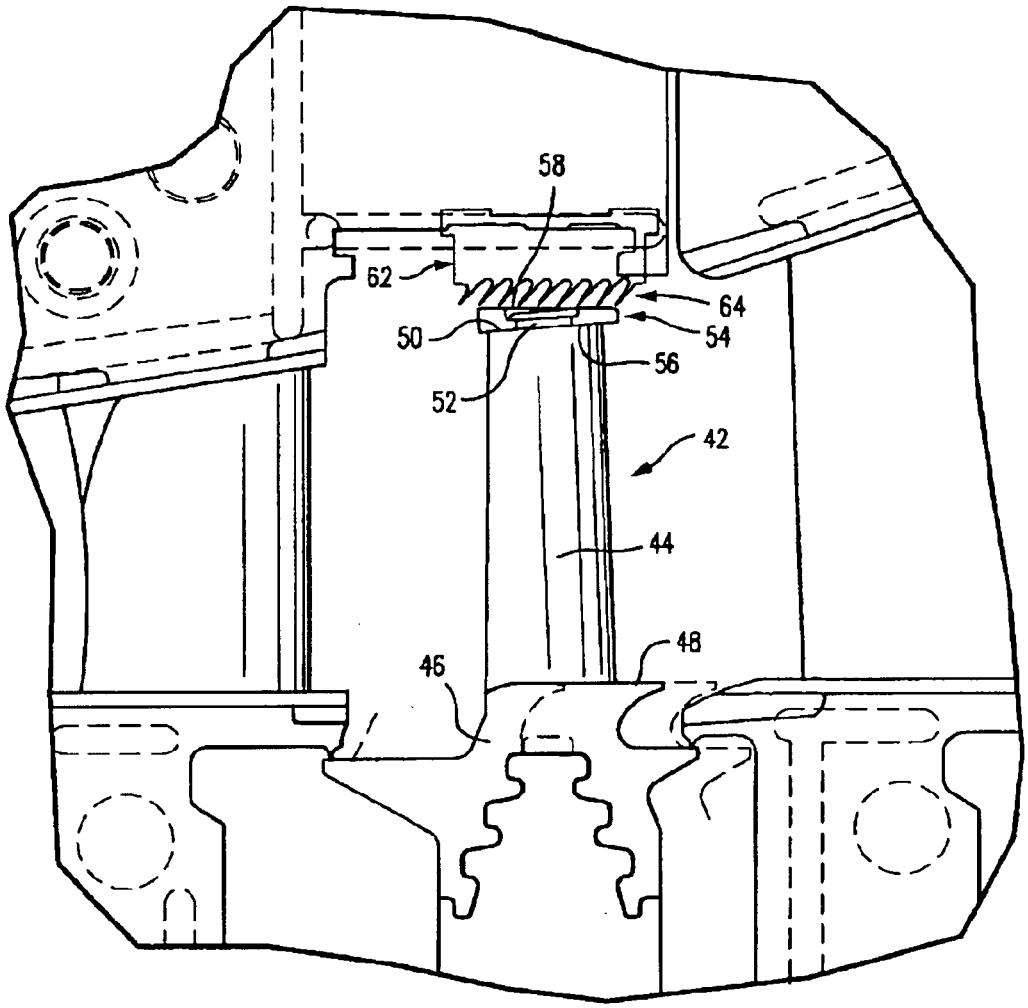
FIG. 2 is a side elevation of a bucket having a bucket cover in accordance with the invention.
Figure 3:
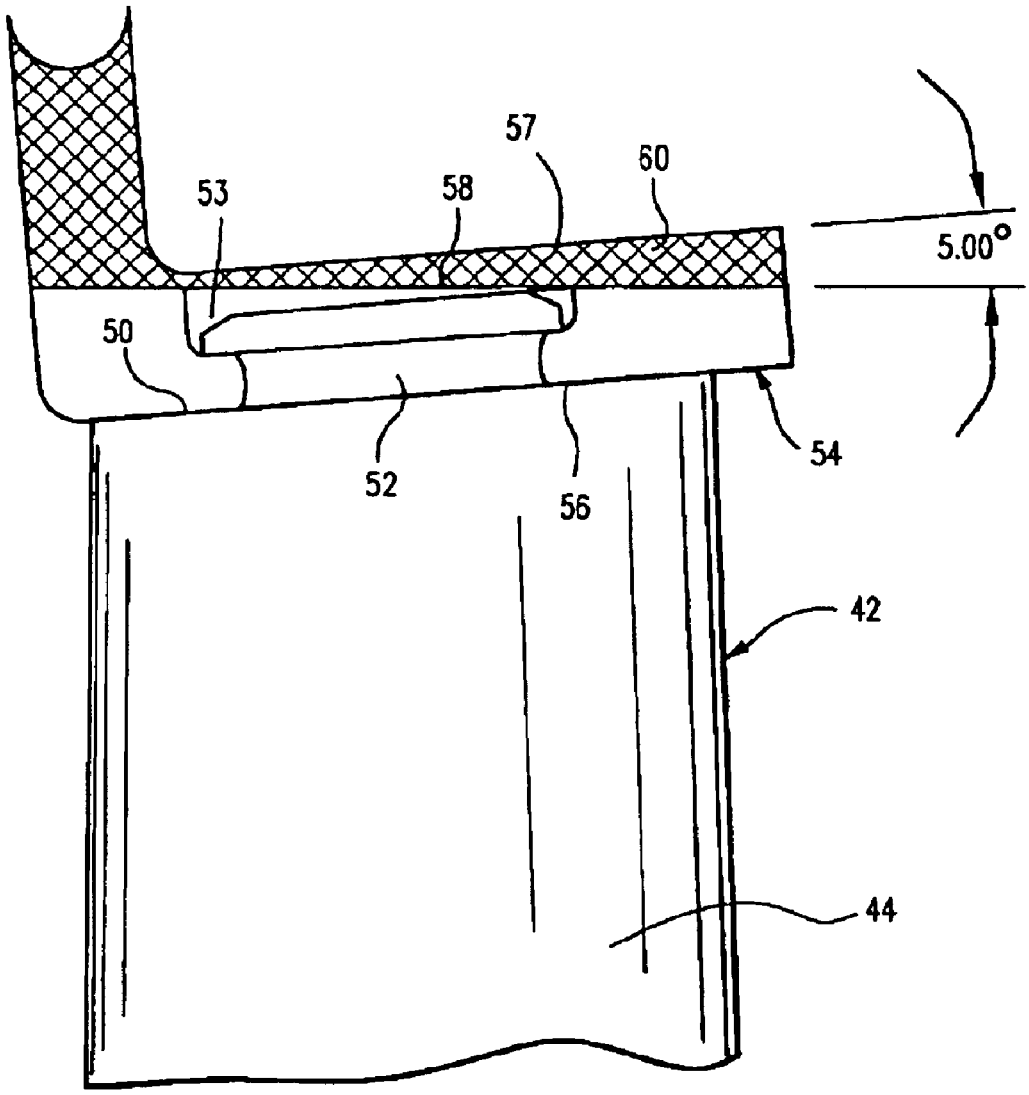
FIG. 3 is a partial side elevation illustrating how a conventional bucket cover shown in FIG. 1 is modified to arrive at the bucket cover of this invention.

With reference now to FIGS. 2 and 3, and in accordance with an exemplary embodiment of this invention, bucket 42 also has an airfoil portion 44 and a shank portion 46 separated by a platform portion 48. The airfoil portion 44 has a sloped, radially outer tip 50, with a tenon 52 projecting radially outward thereof and received in an opening 53 in the bucket cover. The redesigned bucket cover 54 includes a radially inner surface 56 that is seated on the outer tip 50, thus assuming the same acute angle (about 5°) as the tip. Here, however, the radially outer surface 58 of the modified bucket cover 54 is formed by machining an outer portion of the bucket cover to remove the (hatched) material 60 in FIG. 3 such that the new outer surface 58 lies in a plane that is substantially parallel to the longitudinal axis of the rotor, not shown, and also to the labyrinth seal 62 and its array of labyrinth teeth 64. Prior to machining, the radially outer surface 57 was substantially parallel to inner surface 56. This arrangement permits an increased number of the labyrinth teeth 64 to engage the outer surface 58 of the bucket cover, and thus reduce tip leakage losses.

It will be appreciated that the bucket cover 48 can thus be manufactured according to existing methods. It will also be appreciated, however, that the invention contemplates other manufacturing techniques to obtain the desired bucket cover configuration. However, the bucket cover 54 promotes commonality of parts since it can be used with existing labyrinth seals used in other turbine stages. In other words, the labyrinth seal 62 is a more common seal configuration as compared to the labyrinth seal in FIG. 1.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of preparing a turbine bucket cover for use with a turbine bucket adapted for mounting on a rotor having a sloped airfoil tip comprising:

a) providing a bucket cover having substantially parallel radially inner and outer surfaces;

b) removing material from the bucket cover so as to form a new radially outer surface defining an acute angle relative to said radially inner surface; and c) securing said bucket cover on said sloped airfoil tip of said turbine bucket such that said radially outer surface is adapted to be substantially parallel to a longitudinal axis of the rotor.

2. The method of claim 1 wherein said acute angle is about 5°.

3. The method of claim 1 wherein said bucket cover is secured on said sloped airfoil tip by a tenon on said airfoil tip received within an opening in said bucket cover.

4. The method of claim 1 wherein step b) is carried out by machining.

5. The method of claim 1 wherein step c) is performed before step b).

6. A method of preparing a turbine bucket cover for use with a turbine bucket adapted for mounting on a rotor having a sloped airfoil tip comprising:

a) providing a bucket cover having substantially parallel radially inner and outer surfaces;

b) removing material from the bucket cover so as to form a new radially outer surface defining an acute angle relative to said radially inner surface; and c) securing said bucket cover on said sloped airfoil tip of said turbine bucket.

7. The method of claim 6 wherein said acute angle is about 5°.

8. The method of claim 6 wherein said bucket cover is secured on said sloped airfoil tip by a tenon on said airfoil tip received within an opening in said bucket cover.

9. The method of claim 6 step b) is carried out by machining.

10. The method of claim 6 wherein step c) is performed before step b).

11. The method of claim 6 wherein in said bucket cover has a cross-sectional thickness that decreases in a direction of steam flow past the bucket.

* * * * *

UNITED STATES PATENT AND TRADEMARK OFFICE

CERTIFICATE OF CORRECTION

PATENT NO. : 6,851,926 B2
DATED : Feb. 8, 2005
INVENTOR(S) : Guinessine et al.

It is certified that error appears in the above-identified patent and that said Letters Patent is hereby corrected as shown below:

Column 4,
Line 43, insert the word “wherein” after the numeral “6”.
Line 47, after the word “wherein” delete the word “in”

Signed and Sealed this

Seventeenth Day of May, 2005

JON W. DUDAS
*Director of the United States Patent and Trademark Office*